United States Patent [19]

Boundy

[11] Patent Number: 4,697,807

[45] Date of Patent: Oct. 6, 1987

[54] NOVELTY GOLF BALL

[76] Inventor: Francis J. Boundy, 34 Brighton Crescent, Mt. Eliza, Victoria, Australia

[21] Appl. No.: 852,412

[22] Filed: Apr. 16, 1986

[30] Foreign Application Priority Data

Apr. 19, 1985 [AU] Australia ..... PH0224

[51] Int. Cl.[4] ..... A63J 5/02; A63B 37/02; A63B 37/12

[52] U.S. Cl. ..... 272/27 N; 273/380; 273/183 C; 273/58 R; 273/213

[58] Field of Search ..... 273/58 R, 58 F, 58 H, 273/418, 213, 380, 62, 183 C; 272/8 N, 27 R, 27 N

[56] References Cited

U.S. PATENT DOCUMENTS

| | | | |
|---|---|---|---|
| 1,258,467 | 3/1918 | Riley | 273/58 F |
| 3,137,852 | 6/1964 | Hopper | 273/380 X |
| 4,212,460 | 7/1980 | Kraft | 273/58 H X |

FOREIGN PATENT DOCUMENTS

| | | | |
|---|---|---|---|
| 930757 | 7/1973 | Canada | 273/380 |

*Primary Examiner*—George J. Marlo
*Attorney, Agent, or Firm*—Kinney & Lange

[57] ABSTRACT

A simulated golf ball has a unitary outer shell which is dimensionally stable under normal atmospheric conditions but which breaks down into finely divided particles when struck by a golf club. The particles are so small that they cannnot be seen and the shell includes at least one inner compartment which contains a second material that expands when freed when the shell is struck and broken.

8 Claims, 4 Drawing Figures

NOVELTY GOLF BALL

The present invention relates to a novelty ball and in particular a novelty golf ball.

The objective of the present invention is to provide a ball which has the outward appearance of a normal games ball but which performs in a surprising manner when struck during normal play of the game.

To this end the present invention provides a ball having a shell with an outer surface simulating a normal games ball, said outer shell being formed of a material adapted to break down when struck during normal games play, and said outer shell defining at least one inner compartment housing a second material which is freed upon said outer shell being struck and breaking down during normal games play. Conveniently the outer surface simulates a golf ball.

In one preferred embodiment, the second material might comprise any material which is adapted to expand upon being liberated from the ball outer shell. For example coloured sponge rubber or synthetic foam shapes might be compressed within the compartment or compartments such that they expand to their full dimensions upon being liberated. An alternative arrangement might be the housing of fine particulate material such as plaster powder, saw dust or any other such material capable of setting up a dust cloud after the ball is struck.

Conveniently the outer shell is formed from a frangible plastics material, particularly such a material which is adapted to break down into finely divided particles when struck during normal games play.

In accordance with one preferred arrangement, the outer shell of the ball is formed in two halves, at least one of said halves defining a hemispherical outer surface portion and a substantially flat diametral face porton, said diametral face portion having at least one opening therein communicating with an interior region of said one half defining a said inner compartment thereby providing access to the said inner compartment prior to joining said halves together. In another preferred arrangement the outer shell may be formed in substantially one piece with an access opening therein providing access to an interior region of said shell, said access opening being dosed by a plug portion.

The accompanying drawings illustrate one preferred embodiment of the present invention applicable to a golf ball. In the drawings.

Figure 1:
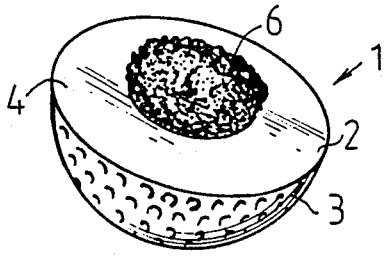
FIG. 1 is a perspective view of a ball half according to this invention.
Figure 2:
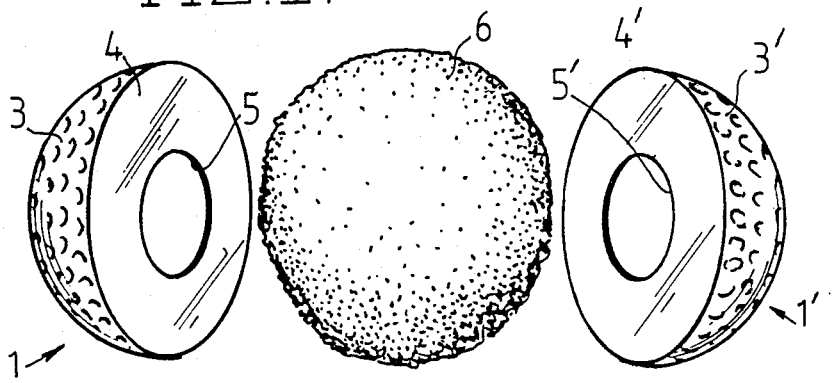
FIG. 2 is a perspective view of two ball halves together with a second material to be housed therein.

Referring now to FIG. 1 there is shown a ball half 1 having an outer shell 2 with a hemispherical surface 3 simulating a normal golf ball. Along the diametric plane of the ball half 1 there is an annular flange 4 defining a central access opening 5 enabling the second material 6 to be inserted into the compartment defined within the outer ball surface 3 and the flange 4. In the embodiment illustrated the second material 6 is a synthetic foam or sponge material which can expand to a reasonably large size in its free state as shown in FIG. 2. Obviously other forms of material could be used. The shell 2 is conveniently made of a brittle resinous material adapted to shatter to finely divided fragments upon being struck during normal golf play. Preferably the fragmentation of the shell is so great (i.e. the particles formed are so fine) that the shell 2 virtually disappears leaving only the second material 6 when struck.

Figure 3:
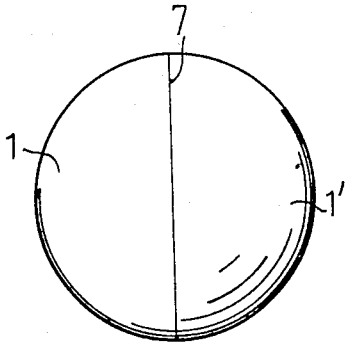
FIG. 3 is a view showing the ball constructed from two halves such as in FIG. 2.

As shown in FIG. 2 a ball is constructed from two shell halves 1 and 1' such that their respective flanges 4, 4' are glued or otherwise adhered together leaving only a very fine circumferential line 7 (FIG. 3) giving any indication at all that the ball is anything other than a normal golf ball. Each shell half might incorporate the second material 6 or this might be contained in only one half as desired. If desired the ball of the present invention might also be weighted as necessary to simulate the weight of a normal games ball.

Figure 4:
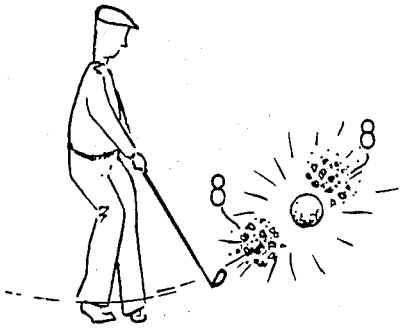
FIG. 4 is a view showing the result of the ball in use.

As demonstrated in FIG. 4, a normal golf ball might be switched for a ball constructed in accordance with the present invention. Thereafter the ball is struck by the unsuspecting person and the shell shatters to fragments 8 leaving only the second material 6 in view.

It will of course be appreciated that the present invention encompasses any obvious modification of the foregoing within the spirit and scope of the invention described therein.

The claims defining the invention are as follows:

1. A ball having a unitary shell with an outer surface simulating a normal golf ball, said shell being formed of a material which is dimensionally stable under normal atmospheric conditions but which is adapted to break down into finely divided particles when struck by a golf club swing by a person during normal games play, the size of said finely divided particles being so small that the particles cannot be seen by the person swinging the golf club, said shell further defining at least one inner compartment housing a second material which expands upon being freed when said shell is struck and broken into said finely divided particles during normal games play.

2. A ball according to claim 1 wherein said second material is a compressible material.

3. A ball according to claim 2 wherein said compressible material comprises one or more shaped articles in their free state.

4. A ball according to claim 3 wherein said compressible material is sponge rubber.

5. A ball according to claim 1 wherein said second material is a finely divided particulate material adapted to expand into a cloud formation when freed from the shell after the ball is struck during normal games play.

6. A ball according to claim 1 wherein said shell is formed in two halves, at least one of said halves defining a hemispherical outer surface and a substantially flat diametral face portion having at least one opening therein, said opening communicating with an interior region of said one half defining a said inner compartment thereby providing access to the said inner compartment prior to joining said halves together to form said unitary shell.

7. A ball according to claim 6 including two said halves each having a said interior region defining a said inner compartment.

8. A ball according to claim 1 wherein said shell is formed in substantially one piece with an access opening therein providing access to an interior region of said shell, said access opening being closed by a plug portion.

* * * * *